US005911173A

United States Patent [19]

Westrom

[11] Patent Number: 5,911,173

[45] Date of Patent: Jun. 8, 1999

[54] BREECH BOLT ASSEMBLY FOR A FIREARM

[76] Inventor: Mark A. Westrom, 230 Cherry Ct., Silvis, Ill. 81282

[21] Appl. No.: 08/735,077

[22] Filed: Oct. 18, 1996

[51] Int. Cl.[6] ..... F41A 3/26

[52] U.S. Cl. ..... 89/185; 89/188

[58] Field of Search ..... 89/188, 184, 185, 89/187.01, 180, 172, 174; 29/1.1

[56] References Cited

U.S. PATENT DOCUMENTS

| | | | |
|---|---|---|---|
| 2,481,548 | 9/1949 | Walfke, Jr. | 89/162 |
| 2,951,424 | 9/1960 | Stoner | 89/191 |
| 3,198,076 | 8/1965 | Stoner | 89/128 |
| 3,507,187 | 4/1970 | Maillard | 89/185 |
| 3,690,218 | 9/1972 | Maillard | 89/185 |
| 3,776,095 | 12/1973 | Atchisson | 89/128 |
| 4,058,922 | 11/1977 | Elbe et al. | 42/16 |
| 4,069,608 | 1/1978 | Jurek | 42/49 |
| 4,079,535 | 3/1978 | Elbe et al. | 42/49 |
| 4,098,016 | 7/1978 | Foote | 42/16 |
| 4,128,042 | 12/1978 | Atchisson | 89/138 |
| 4,169,329 | 10/1979 | Atchisson | 42/16 |
| 4,398,448 | 8/1983 | LaFever | 89/185 |
| 4,502,237 | 3/1985 | Krogh | 42/50 |
| 4,502,367 | 3/1985 | Sullivan | 89/181 |
| 4,514,922 | 5/1985 | Farrar et al. | 42/50 |
| 4,617,749 | 10/1986 | Jurek | 42/16 |
| 4,653,210 | 3/1987 | Poff, Jr. | 42/16 |
| 4,664,015 | 5/1987 | Kennedy | 89/138 |
| 4,698,931 | 10/1987 | Larsson | 42/16 |
| 4,888,900 | 12/1989 | Howard | 42/50 |
| 5,279,059 | 1/1994 | Howard | 42/90 |
| 5,351,598 | 10/1994 | Schuetz | 89/185 |
| 5,357,703 | 10/1994 | Chesnut et al. | 42/50 |

FOREIGN PATENT DOCUMENTS

| | | | |
|---|---|---|---|
| 52759 | 6/1942 | Netherlands | 89/188 |

*Primary Examiner*—Stephen M. Johnson
*Attorney, Agent, or Firm*—Woodard, Emhardt, Naughton, Moriarty & McNett

[57] ABSTRACT

Reliability of a multi-lug breech bolt is improved by modifying the bearing relationship between the bolt lugs and the matching lugs within a gun receiver. This procedure is applied to a gun that has a receiver housing a breech bolt and an extractor. The extractor is coupled to the breech bolt and configured to move relative thereto. The bolt for this gun has at least five radially extending bolt lugs configured for bearing contact with the receiver when positioned for firing. The bolt lugs include a first, second, and third bolt lug with the first and second bolt lugs being adjacent and defining a gap configured to receive the extractor therebetween. The third bolt lug extends from the bolt opposite the gap. Stress imparted to the first and second bolt lugs from firing the gun is reduced by altering the gun to, prevent formation of a bearing relationship between the third bolt lug and the receiver when the bolt lugs are positioned for firing. The gun is reassembled as part of the procedure. The alteration may be accomplished by removing material from the third lug, a corresponding lug of the receiver, or both.

24 Claims, 5 Drawing Sheets

BREECH BOLT ASSEMBLY FOR A FIREARM

BACKGROUND OF THE INVENTION

The present invention relates to firearm breech bolt assemblies, and more particularly, but not exclusively, relates to enhancement of breech bolt reliability.

The M-16 automatic rifle has been a standard weapon of choice for the U.S. Military. The M-16 family of weapons includes semi-automatic counterparts which are popular with the civilian sector. Generally, the M-16 family of automatic and semi-automatic firearms are based on a gas operated breech bolt carrier system. As used herein, "gun" or "firearm" refers to a completely assembled weapon including not only a receiver operable to fire rounds of ammunition, but also any other structure normally associated with the given weapon. U.S. Pat. Nos. 2,951,424 and 3,198,076 to Stoner provide early examples of the M-16 type of weapon. In recent years, many variations and modifications of the M-16 family have evolved.

Generally, for the current M-16 weapon family, the bolt carrier system includes a multi-lug breech bolt which interlocks within the gun receiver for firing each round of ammunition. The reaction force from firing a round is transmitted from the breech bolt through the lugs and results in the "recoil" force experienced by the marksman. In one common configuration of the M-16 weapon, a steel "barrel extension" is used to interface with the gun barrel and interlock with the lugs of the breech bolt. Generally, the barrel extension contains pressurized gases resulting from firing of the weapon, and transmits the familiar recoil force. As used herein, a "receiver" includes a barrel extension, barrel interface, or any other part or assembly of a gun or firearm that has one or more surfaces configured to engage lugs of a breech bolt.

Regardless of the receiver configuration, breech bolts are typically subjected to repeated stress from firing the gun. Occasionally, the breech bolt fails from fatigue induced by this repeated stress. These failures limit the overall reliability of the weapon, sometimes represented as Mean-Time-Between-Failure (MTBF). By reducing the frequency of these failures, maintenance actions for the gun are correspondingly reduced and overall reliability is improved. Consequently, there is a need to better accommodate stress imposed on the breech bolt from firing the weapon.

SUMMARY OF THE INVENTION

The present invention relates to firearm breech bolt assemblies. Various aspects of the invention are novel, non-obvious, and provide various advantages. While the actual nature of the invention covered herein can only be determined with reference to the claims appended hereto, certain features which are characteristic of the preferred embodiment disclosed herein can be described briefly.

One aspect of the present invention is improving reliability of a multi-lug breech bolt by modifying the bearing relationship between the bolt lugs and matching lugs within a gun receiver. This procedure is applied to a gun that has a receiver housing a breech bolt and an extractor. The extractor is coupled to the breech bolt and configured to move relative thereto. The bolt for this gun has at least five radially extending bolt lugs configured for bearing contact with the receiver when positioned for firing. The bolt lugs include a first, second, and third bolt lug with the first and second bolt lugs being adjacent and defining a gap configured to receive the extractor therebetween. The third bolt lug extends from the bolt opposite the gap. Stress imparted to the first and second bolt lugs from firing the gun is reduced by altering the gun to prevent formation of a bearing relationship between the third bolt lug and the receiver when the bolt lugs are positioned for firing. The gun is reassembled as part of the procedure. The alteration may be accomplished by removing material from the third lug, a corresponding lug of the receiver, or both.

In another aspect of the present invention, reliability of a gun is improved by providing a breech bolt that has at least five radially extending bolt lugs designed for bearing contact with the gun receiver when positioned for firing. The bolt lugs include a first, second, and third bolt lug with the first and second bolt lugs being next to each other and the third lug extending from the bolt opposite a point between the first and second lugs. Material is removed from the third bolt lug to prevent formation of a bearing relationship between the third bolt lug and the receiver when the bolt lugs are positioned for firing.

Still another aspect of the present invention is a breech bolt having an elongate body with a first end opposing a second end along a longitudinal axis. The body also has a generally cylindrical portion between the first and second ends. A number of bolt lugs are integrally connected to the body and radially extend from the body about the longitudinal axis. The number of bolt lugs are fixed relative to each other and each has a first face opposing a second face along the longitudinal axis with the first face being closer to the first end than the second face. The number of bolt lugs includes a plurality of at least five bolt lugs having generally coplanar second faces each configured as a bearing surface. The plurality of bolt lugs has a lug pair with a first lug adjacent a second lug. Also, the number of bolt lugs includes an offset bolt lug extending opposite a point between the first and second lugs. The second face of the offset bolt lug is offset a distance along the longitudinal axis from the second face of each of the plurality of bolt lugs. This offset lug improves stress distribution among the plurality of bolt lugs when the breech bolt is configured in a gun.

A further aspect is a gun with a receiver defining a cavity and a breech bolt housed within the cavity. The bolt reciprocally moves within the cavity to fire the gun and is configured to interlock with the receiver in a firing position. The bolt includes a number of opposing lug pairs radially extending from the body. Each of the lug pairs has a first member opposite a second member along a corresponding transverse axis. The first and second members each have a mating surface configured for bearing contact with the receiver when said bolt is in the firing position. The gun also includes an extractor coupled to the bolt and being configured to move relative thereto. The bolt includes an unmatched lug extending from the body opposite the extractor between two lugs belonging to the lug pairs, and the gun is configured to prevent formation of a bearing relationship between the unmatched lug and the receiver when the bolt is in the firing position and the gun is in a normal operating condition. Prevention of this bearing relationship more evenly distributes stress from firing the gun among the lug pairs; thus generally improving reliability.

Accordingly, it is one object of the present invention to improve reliability of a firearm having a multi-lug breech bolt.

It is another object of the present invention to improve reliability of the breech bolt assembly of a firearm by modifying at least one selected lug of the assembly.

Further objects, features, aspects, and advantages of the present invention will become apparent from the drawings and description contained herein.

DESCRIPTION OF THE PREFERRED EMBODIMENT

Figure 1:
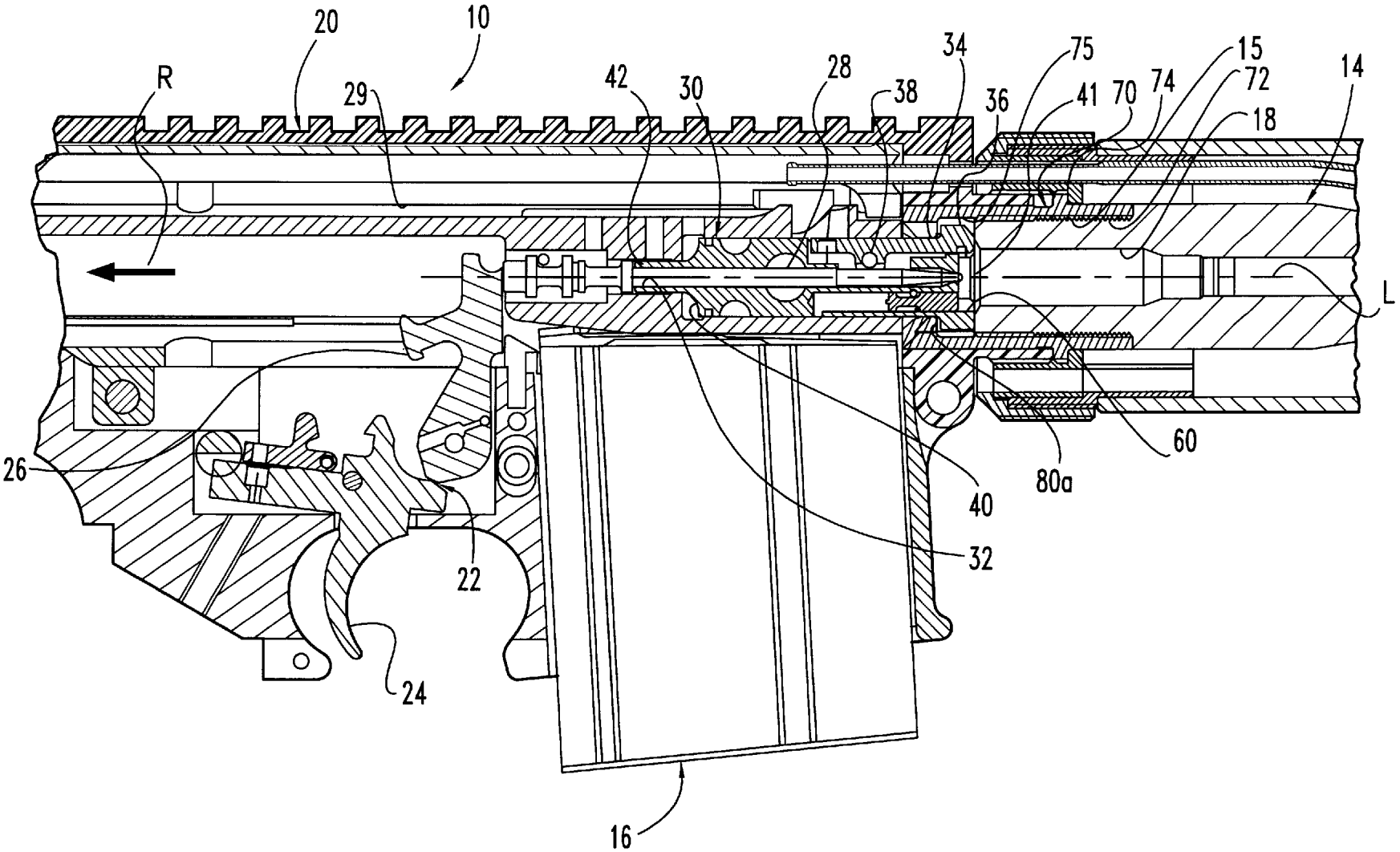
FIG. 1 is a diagrammatic cross-sectional side view of one embodiment of the present invention.

For the purposes of promoting an understanding of the principles of the invention, reference will now be made to the embodiment illustrated in the drawings and specific language will be used to describe the same. It will nevertheless be understood that no limitation of the scope of the invention is thereby intended. Any alterations and further modifications in the described device, and any further applications of the principles of the invention as described herein are contemplated as would normally occur to one skilled in the art to which the invention relates.

FIG. 1 depicts firearm 10 of one embodiment of the present invention. Firearm 10 has barrel 14 and magazine 16. Magazine 16 is configured to consecutively feed cartridges to firing chamber 18 through receiver 20. Receiver 20 includes trigger assembly 22 with spring-loaded trigger 24, spring-loaded hammer 26, and firing pin 28. Receiver 20 defines cavity 29 configured to house breech bolt assembly 30. Breech bolt assembly 30 defines firing pin bore 32 through which firing pin 28 extends. Breech bolt assembly 30 also includes spring-loaded extractor 34 and breech bolt 40. Extractor 34 has guide flange 36 and is pivotably coupled by pivot pin 38 to breech bolt 40.

Figure 2:
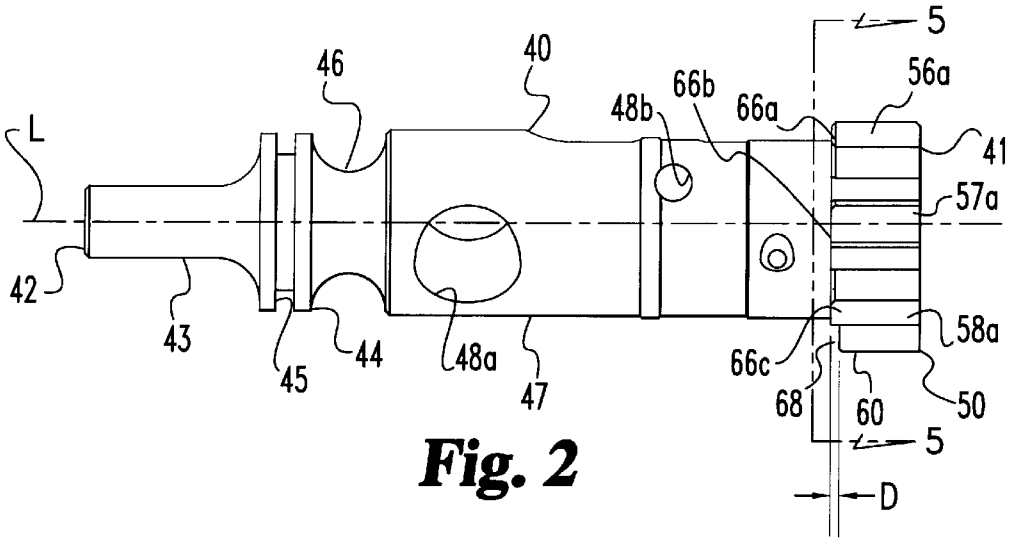
FIG. 2 is a side view of the breech bolt of the embodiment depicted in FIG. 1.
Figure 3:
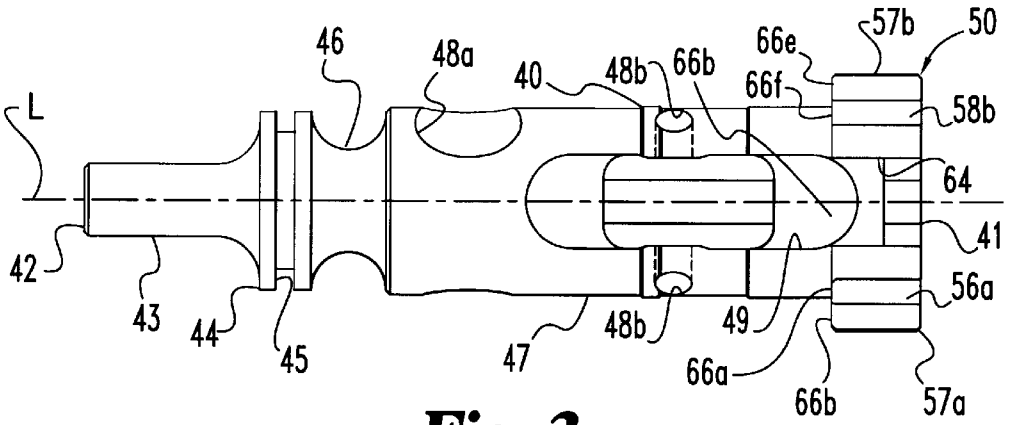
FIG. 3 is a top view of the breech bolt depicted in FIG. 2.
Figure 4:
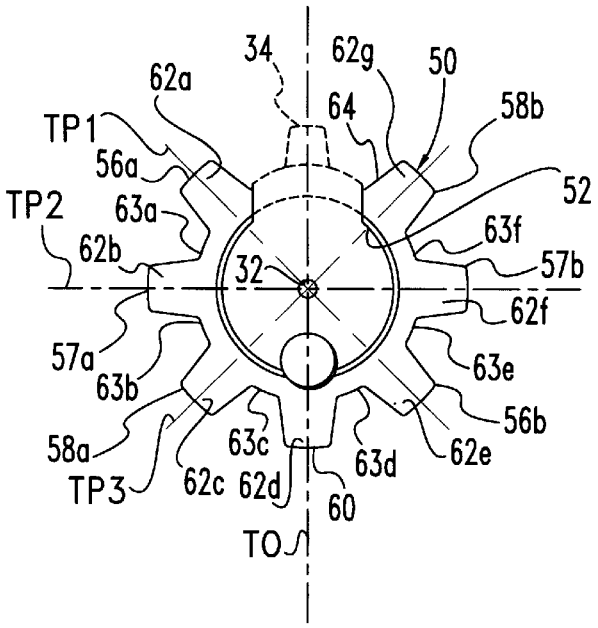
FIG. 4 is an end view of the breech bolt depicted in FIG. 2.

Referring additionally to FIGS. 2–4, further description of breech bolt 40 is provided. Bolt 40 has front end 41 opposing back end 42 along longitudinal axis L. Bolt 40 is integrally formed with stem 43 adjacent back end 42. Sealing flange 44 is generally circular and is integrally connected to stem 43. Sealing flange, 44 defines a circumferential groove 45 configured to receive a sealing ring (not shown). Bolt 40 is also formed with neck 46 positioned between sealing flange 44 and cylindrical body portion 47. Cylindrical body portion 47 defines bores 48*a* and 48*b*. Cylindrical body portion also defines extractor cavity 49 configured to receive extractor 34 therein. Bore 48*b* is configured to receive extractor pivot pin 38 therethrough.

Breech bolt 40 also includes lug portion 50 integrally connected thereto. Lug portion 50 defines cartridge recess 52 in front end 41. Cartridge recess 52 is configured to removably retain the end of a cartridge therein.

Lug portion 50 also includes a number of bolt lugs 56*a*, 56*b*; 57*a*, 57*b*; 58*a*, 58*b*; and 60 which radially extend about longitudinal axis L. Lugs 56*a*, 56*b* (collectively designated lug pair 56) extend opposite each other along axis transverse radial TP1. Lugs 57*a*, 57*b* (collectively designated lug pair 57) extend opposite each other along transverse radial axis TP2. Lugs 58*a*, 58*b* (collectively designated lug pair 58) extend opposite each other along transverse radial axis TP3. Bolt lug 60 is relatively shorter along longitudinal axis L than each lug of lug pairs 56, 57, 58, and extends along transverse radial axis TO opposite a location between adjacent lugs 56*a*, 58*b*. This location is configured to receive a portion of extractor 34 as shown in phantom in FIG. 4. Axes TP1, TP2, TP3, and TO are perpendicular to longitudinal axis L.

Each lug 56*a*, 57*a*, 58*a*, 60, 56*b*, 57*b*, 58*b* defines a corresponding end face 62*a*, 62*b*, 62*c*, 62*d*, 62*e*, 62*f*, 62*g* (collectively designated end faces 62). Gap 63*a* is defined between lugs 56*a* and 57*a*. Gap 63*b* is defined between lugs 57*a* and 58*a*. Gap 63*c* is defined between lugs 58*a* and 60. Gap 63*d* is defined between lugs 60 and 56*b*. Gap 63*e* is defined between lugs 56*b* and 57*b*. Gap 63*f* is defined between lugs 57*b* and 58*b*. Collectively, gaps 63*a*, 63*b*, 63*c*, 63*d*, 63*e*, 63*f* are designated gaps 63. Extraction gap 64 is defined between lugs 56*a* and 58*b*, and is adapted to receive a portion of extractor 34.

Figure 5:
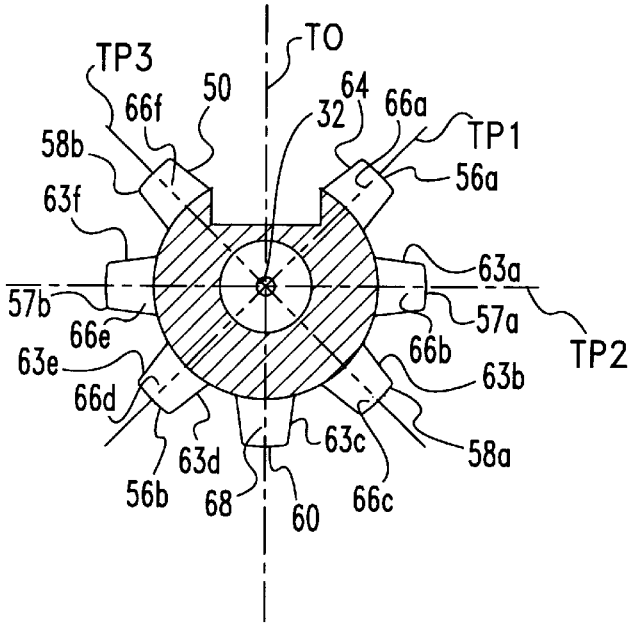
FIG. 5 is a cross-sectional end view of the breech bolt taken along the section line 5—5 depicted in FIG. 2.
Figure 6:
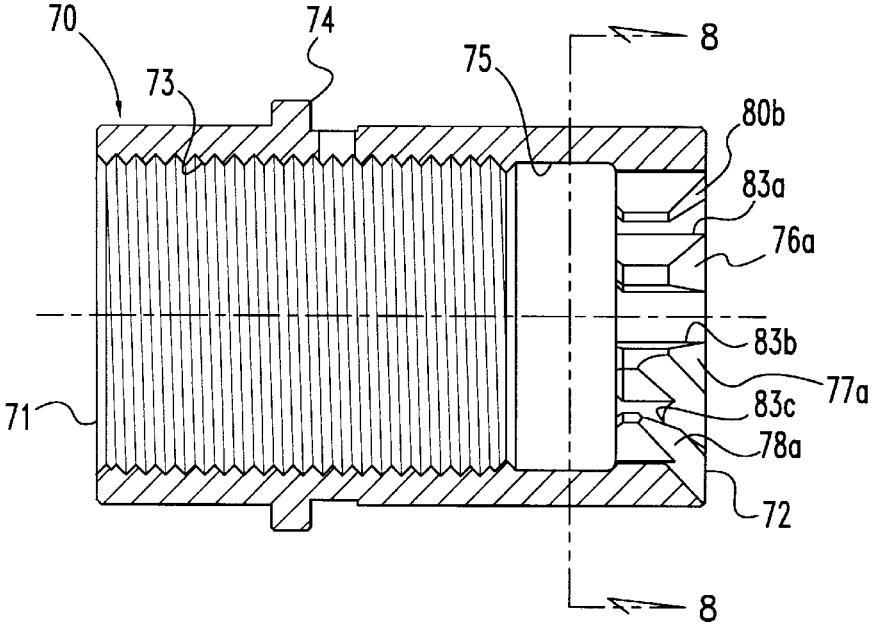
FIG. 6 is a cross-sectional side view of the barrel interface of the embodiment depicted in FIG. 1.
Figure 7:
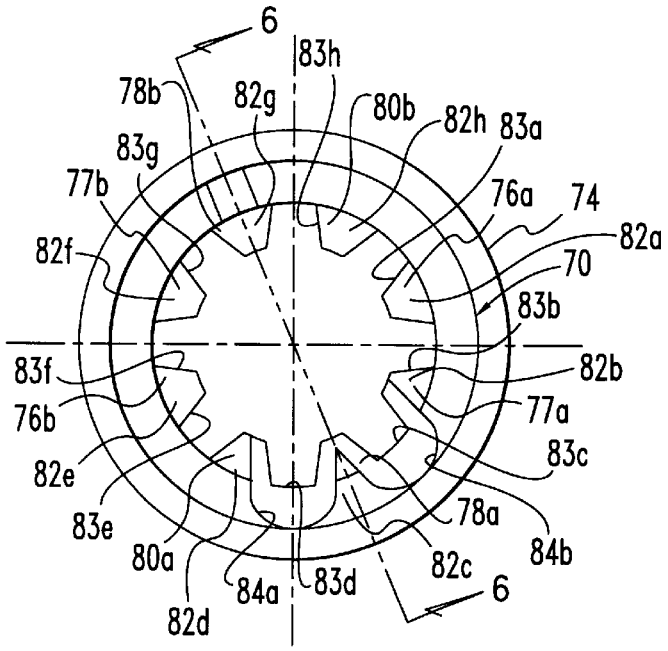
FIG. 7 is an end view of the barrel interface depicted in FIG. 6.

FIGS. 4 and 5 depict the the paired lugs 56*a*, 57*a*, 58*a*, 56*b*, 57*b*, 58*b* with bearing faces 66*a*, 66*b*, 66*c*, 66*d*, 66*e*, 66*f*, respectively, which are collectively designated bearing faces 66. Each bearing face 66 is generally planar and extends away from longitudinal axis L. Bolt lug 60 has offset face 68 which is also generally planar. Face 68 is offset from bearing faces 66 by distance D along longitudinal axis L. Distance D is exaggerated in FIG. 2 for the purposes of illustration.

Receiver 20 also includes barrel interface 70 as illustrated in FIGS. 1 and 6–8. Barrel interface 70 is configured as a barrel extension that interlocks with lug portion 50 of breech bolt assembly 30 for firing. Barrel interface 70 has barrel receiving end 71 opposite bolt receiving end 72. Adjacent barrel receiving end 71 is threaded portion 73 configured to engage threaded end 15 of barrel 14 (see FIG. 1). Circumferential outer flange 74 protrudes from barrel interface 70 about threaded portion 73. Between bolt receiving end 72 and threaded portion 73 is bolt interlocking chamber 75.

Figure 8:
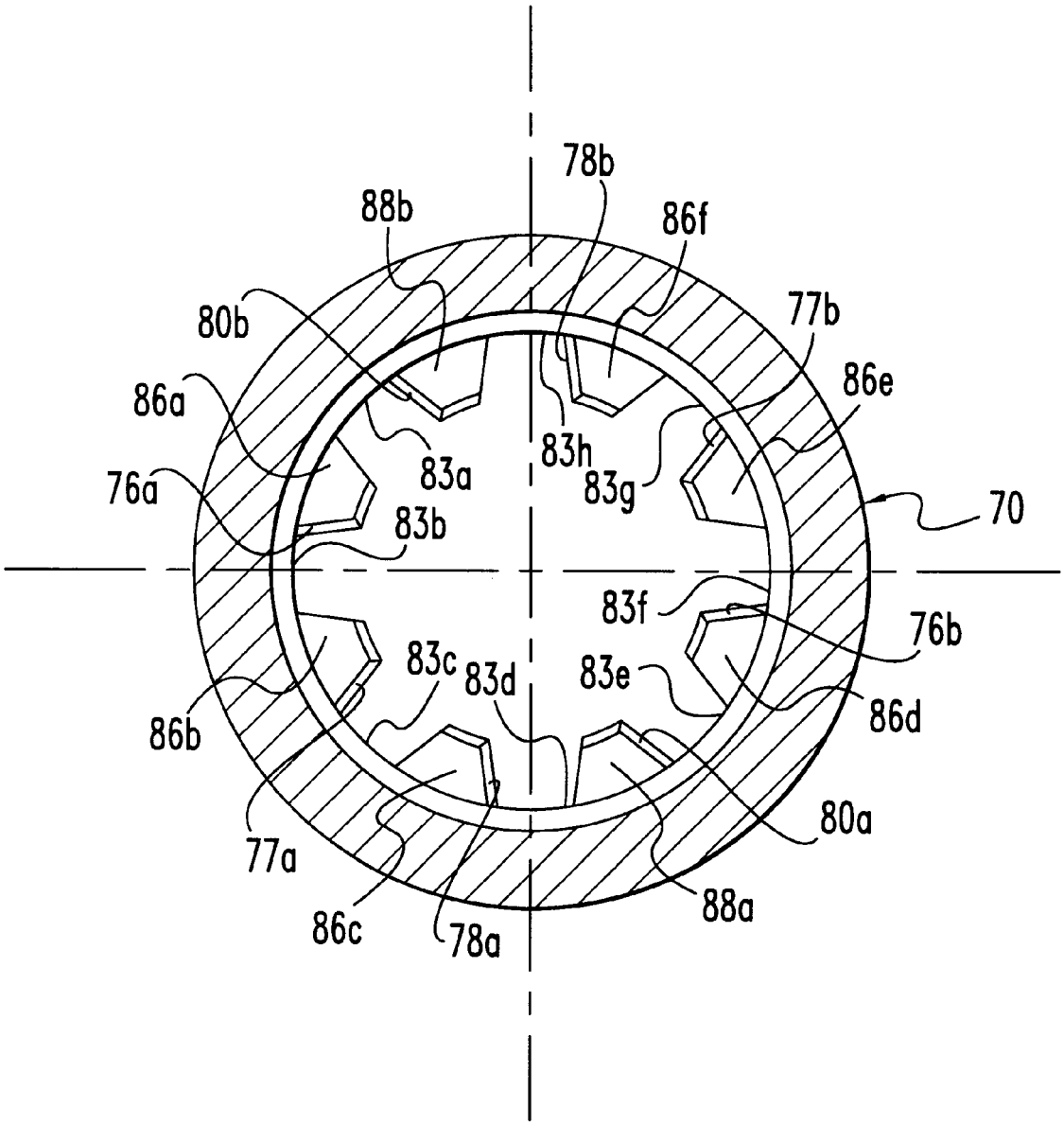
FIG. 8 is a cross-sectional end view of the barrel interface taken along the section line 8—8 depicted in FIG. 6.

Between interlocking chamber 75 and bolt receiving end 72 are receiver lugs 76*a*, 76*b* (collectively designated lug pair 76); 77*a*, 77*b*. (collectively designated lug pair 77); 78*a*, 78*b* (collectively designated lug pair 78); and 80*a*, 80*b* (collectively designated lug pair 80). Each of these lugs has a corresponding guide face 82*a*, 82*b*, 82*c*, 82*d*, 82*e*, 82*f*, 82*g*, 82*h* (collectively designated guide faces 82). Between adjacent lugs of lug pairs 76, 77, 78, 80, gaps 83*a*, 83*b*, 83*c*, 83*d*, 83*e*, 83*f*, 83*g*, 83*h* are defined which are collectively designated gaps 83. Next to gaps 83*d*, 83*e*, are ramp surfaces 84*a*, 84*b*. Referring particularly to FIG. 8, lugs 76*a*, 77*a*, 78*a*, 76*b*, 77*b*, 78*b* have corresponding bearing faces 86*a*, 86*b*, 86*c*, 86*d*, 86*e*, 86*f*. Lugs 80*a*, 80*b*, have offset faces 88*a*, 88*b*, respectively.

In operation, breech bolt assembly 30 moves in a reciprocal fashion along longitudinal axis L when rounds are fired from firearm 10 in a conventional automatic or semi-automatic manner. U.S. Pat. No. 2,951,424 to Stoner, U.S. Pat. No. 3,198,076 to Stoner, and U.S. Pat. No. 5,351,598 to Schuetz provide further information pertinent to this process. Generally, this process begins when a cartridge is fed from magazine 16 into cartridge recess 52 while breech bolt assembly 30 is in the rearward (or open) position (not shown). Once a cartridge is loaded, bolt 40 then slides forward opposite the direction indicated by arrow R, positioning the cartridge into firing chamber 18. As bolt 40 moves forward, lugs of lug portion 50 pass by lugs of barrel interface 70 in an interdigitating fashion. Specifically, lugs 56*a,* 57*a,* 58*a,* 60, 56*b,* 57*b,* 58*b* of lug portion 50 pass through gaps 83*a,* 83*b,* 83*c,* 83*d,* 83*e,* 83*f,* 83*g,* of barrel interface 70. Also, guide flange 36 of extractor 34 passes through gap 83*h.* Likewise, lugs 76*a,* 77*a,* 78*a,* 80*a,* 76*b,* 77*b,* pass through gaps 63*a,* 63*b,* 63*c,* 63*d,* 63*e,* 63*f* of lug portion 50, and lugs 78*b,* 80*b* pass through extractor gap 64 on opposing sides of guide flange 36.

Once lugs of bolt 40 and barrel interface 70 have passed by one another, breech bolt assembly 30 rotates about axis L to interlock the breech in a closed position, including the rotation of lug portion 50 within interlocking chamber 75 of barrel interface 70 using conventional techniques. As a result, bearing faces 66*a,* 66*b,* 66*c,* 66*d,* 66*e,* 66*f* of lug portion 50 make contact with bearing faces 86*a,* 86*b,* 86*c,* 86*d,* 86*e,* 86*f* of barrel interface 70. Notably, guide flange 36 of extractor 34 is offset from the bolt lugs of lug portion 50 so that no contact is made between guide flange 36 and offset face 88*b* of receiver lug 80*b*. Furthermore, it should be noted that the offset face 68 of bolt lug 60 does not contact offset face 88*a*. Once breech bolt assembly 30 rotates into an interlocking closed position with barrel interface 70, the cartridge in firing chamber 18 may be fired by pulling trigger 24. This pulling motion causes trigger 24 to rotate which in turn causes hammer 26 to rotate from an engaged, cocked position with trigger 24 (not shown) to an unengaged position as reflected in FIG. 1. After rotating, hammer 26 strikes firing pin 28. Consequently, firing pin 28 moves within bolt 40 so that it impacts the cartridge in firing chamber 18, causing it to fire. The position of trigger assembly 20 and breech bolt assembly 30 just after firing is illustrated in FIG. 1.

Once a cartridge is fired, breech bolt assembly 30 is rotated to unlock, and slides back in a direction along arrow R to the open position and extracts the spent shell before another cartridge is loaded into loading chamber 18 from magazine 16. This process of consecutively firing and loading proceeds for a number of cartridges at the discretion of the shooter.

The firing of a cartridge in firing chamber 18 causes a recoil force in the direction indicated by arrow R. As a consequence, bolt lug pairs 56, 57, 58 are pushed back against receiver lug pairs 76, 77, 78, respectively, forming load bearing relationships between bearing faces 76 of lug portion 50 and 86 of barrel interface 70.

It has been found that by configuring bolt lug 60 with offset face 68 such that no bearing relationship forms with corresponding receiver lug 80*a,* that the stress of firing is more evenly distributed among lug pairs 56, 57, 58. Notably, these lug pairs are generally symmetric about a point of symmetry corresponding to the perpendicular intersection of longitudinal axis L with the view plane of FIGS. 4 and 5. Also, it should be understood that guide flange 36 of extractor 34 is configured to move relative to bolt 40, including lug portion 50. As a result, guide flange 36 cannot appreciably bear the load of firing. Indeed, it is preferred that load bearing contact between extractor 34 and barrel interface 70 be avoided.

Furthermore, it has been discovered that lugs 56*a,* 58*b* bear a disproportionally high load from firing if a substantial bearing relationship is allowed to form between face 68 of lug 60 and barrel interface 70. This lug 60 bearing relationship with barrel interface 70 subjects lugs 56*a,* 58*b* to greater stress often resulting in fatigue and fracture of lug 56*a* or 58*b* The more even stress distribution provided by maintaining separation of bolt lug 60 and receiver lug 80*a* when in the interlocked closed position for firing generally decreases bolt lug failure rate—improving overall reliability of bolt 40, breech bolt assembly 30, and firearm 10.

Preferably, offset distance D separating face 68 of bolt lug 60 and face 88*a* of receiver lug 80 is at least 0.01 inch. More preferably, distance D is in a range of about 0.02 to 0.03 of an inch. Most preferably, distance D is about 0.024 of an inch.

In one embodiment, bolt lug 60 is initially formed with a bearing surface that is not offset with respect to bearing faces 66 of the other bolt lugs of lug pairs 56, 57, 58; however, bolt lug 60 is relieved by removing material to form offset face 68 using conventional machining techniques. This embodiment may include the disassembly of an existing firearm to identify the bearing surface of an "unpaired" or "unmatched" breech bolt lug, and then machining this surface to prevent formation of a bearing relationship during firing. In an alternative embodiment, the breech bolt is initially formed with offset face 68 being offset distance D from bearing faces 66. A bolt in accordance with this embodiment may be included in new firearms or supplied as a replacement or substitute part. Likewise, this bolt may also be used to replace a broken or worn breech bolt, or provided as a substitute for the breech bolt of an existing weapon as a preventive maintenance action.

In other embodiments, a receiver lug, such as lug 80*a,* is configured to prevent formation of a bearing relationship with unpaired lug 60 in the closed breech position. The design or alteration of receiver lug 80*a* to prevent formation of a bearing relationship may be in addition to the formation or alteration of lug 60 to provide separation, or in lieu of altering or adapting bolt 40 to establish this aspect of the present invention. Indeed, bolt lug 60 may be formed to have a surface not offset from bearing faces 66, but still remain separated from receiver lug 80*a* by appropriate alteration or formation of offset face 88*a* to provide separation in the closed breech position.

In fact, lugs 60, 80*a,* 80*b* may be removed entirely; however, it is preferred that these lugs remain to provide assistance guiding bolt 40 into interlocking chamber 75 and to provide for load bearing during firing if the other lugs fail. Nonetheless, when firearm 10 is in intended working order, substantial bearing contact between offset face 68 and 88*a* is generally avoided. Similarly, bearing contact between guide flange 36 and offset face 88*b* is preferably avoided under normal operating conditions of firearm 10.

Preferably, the components of breech bolt assembly 30 and barrel interface 70 are manufactured from a metal suitable for use in firearms using techniques known to those skilled in the art. Furthermore, it is preferred that bolt 40 and barrel interface 70 each be formed from a single, unitary piece of material; however, in alternative embodiments, bolt 40 and barrel interface 70 may each be made by coupling two or more separate components as would occur to one skilled in the art. Also, it is contemplated that bolt assembly 30, bolt 40, and barrel interface 70 may be formed from different materials suitable for their intended purpose.

All publications and patent applications cited in this specification are herein incorporated by reference as if each individual publication or patent application were specifically and individually indicated to be incorporated by reference.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A method for increasing reliability of a gun, comprising:

(a) disassembling the gun, the gun having a receiver housing a breech bolt and an extractor, the extractor being coupled to the breech bolt and configured to move relative thereto, the bolt having at least five radially extending bolt lugs each configured for bearing contact with a corresponding one of a number of receiver lugs of the receiver when positioned for firing, the bolt lugs including a first, second, and third bolt lug, the third bolt lug extending from the bolt opposite a location between the first and second bolt lugs configured to receive the extractor;

(b) providing a more uniform loading relationship between the bolt lugs and the receiver lugs when firing the gun by altering the gun to prevent formation of a bearing relationship between the third bolt lug and the corresponding one of the receiver lugs when the bolt lugs and the receiver lugs are positioned for firing; and (c) reassembling the gun.

2. The method of claim 1, wherein said providing includes removing material from the receiver.

3. The method of claim 1, wherein said providing includes removing material from the third bolt lug to prevent the bearing relationship from forming therewith.

4. The method of claim 1, wherein the bolt has at least seven bolt lugs and the receiver has a barrel interface with at least seven receiver lugs.

5. The method of claim 4, wherein the bolt has an elongate body with a first end opposing a second end along a longitudinal axis, the bolt lugs radially extend from the body about the longitudinal axis closer to the first end than the second end, and the third bolt lug has a shorter length along the longitudinal axis than any other of the bolt lugs.

6. The method of claim 1, wherein the first, second, and third bolt lugs are integrally connected to the bolt and the extractor includes a guide flange opposite the third lug.

7. The method of claim 1, wherein the bolt has an elongate body along a longitudinal axis and the bolt lugs extend radially from the body about the longitudinal axis, the bolt lugs each have a face, and the face of the third bolt lug is offset from the face of any other member of the bolt lugs by a distance along the longitudinal axis of at least 0.01 of an inch.

8. The method of claim 7, wherein the distance is in the range of about 0.02 to 0.03 of an inch.

9. The method of claim 8, wherein the distance is about 0.024 of an inch.

10. The method of claim 1, wherein said providing includes removing material from only the third bolt lug.

11. The method of claim 1, wherein the third lug is the only lug from which material is removed to prevent formation of a bearing relationship with the receiver.

12. A method for improving reliability of a gun, comprising:

(a) providing a breech bolt for a gun receiver, the bolt having at least five radially extending bolt lugs configured for bearing contact with the gun receiver when positioned for firing, the bolt lugs including a first, second, and third bolt lug, the first and second bolt lugs being next to each other and the third bolt lug extending from the bolt opposite a point between the first and second bolt lugs; and (b) removing material from the third bolt lug to prevent formation of a bearing relationship between the third bolt lug and the receiver when the bolt lugs are positioned for firing.

13. The method of claim 12, further comprising obtaining the bolt by disassembly of the gun.

14. The method of claim 12, further comprising:

(c) disassembling the gun to remove the bolt;

(d) locating the third lug; and (e) reassembling the gun.

15. The method of claim 12, wherein the bolt has at least seven bolt lugs and the receiver has a barrel interface with at least seven receiver lugs corresponding to the bolt lugs.

16. The method of claim 12, wherein the bolt extends along a longitudinal axis, the bolt lugs each have a face, and the face of the third bolt lug is offset from the face of any other member of the bolt lugs by a distance along the longitudinal axis of at least 0.01 of an inch.

17. The method of claim 16, wherein the distance is in the range of about 0.02 to 0.03 of an inch.

18. The method of claim 17, wherein the distance is about 0.024 of an inch.

19. A method for improving the reliability of a gun, comprising:

(a) providing a breech bolt for a gun receiver, the bolt including an elongate body with a pair of opposing ends along a longitudinal axis of the body and at least five radially extending bolt lugs, said bolt lugs each having an end face opposite a bearing face along the longitudinal axis, the bearing face being positioned along the longitudinal axis between the end face and one of the opposing ends for each of the bolt lugs, the bolt lugs including a first, second and third bolt lug, the first and second bolt lugs being next to each other and the third bolt lug extending from the bolt opposite a point between the first and second bolt lugs; and (b) removing material from the bearing face of the third bolt lug to form an offset face to prevent formation of a bearing relationship between the third bolt lug and the receiver when the bolt lugs are positioned for firing relative to the receiver.

20. The method of claim 19, wherein the gun receiver includes a plurality of receiver lugs each corresponding to one of the bolt lugs, the bearing face of each of the bolt lugs being configured to contact a corresponding one of the receiver lugs if the bolt is put in a firing position relative to the receiver before said removing, and the offset face of the third bolt being spaced apart from the corresponding one of the receiver lugs if the bolt is put in a firing position relative to the receiver after said removing.

21. The method of claim 19, wherein said removing includes providing a more uniform loading relationship between the bolt lugs and the receiver when the bolt is put in a firing position in the receiver and the gun is fired.

22. The method of claim 19, wherein the offset distance is at least 0.01 of an inch.

23. The method of claim 19, wherein the offset distance is at least 0.02 of an inch.

24. The method of claim 19, wherein only the third lug is altered during said removing.

* * * * *